US006988285B1

(12) United States Patent
Sewell

(10) Patent No.: US 6,988,285 B1
(45) Date of Patent: Jan. 24, 2006

(54) METHOD OF CATCHING IN TRUST FALL IN ROPES COURSE

(75) Inventor: Coy Travis Sewell, 5839 S. Joplin, Tulsa, OK (US) 74135

(73) Assignee: Coy Travis Sewell, Tulsa, OK (US)

( * ) Notice: Subject to any disclaimer, the term of this patent is extended or adjusted under 35 U.S.C. 154(b) by 165 days.

(21) Appl. No.: 10/655,722

(22) Filed: Sep. 5, 2003

(51) Int. Cl.
*A62B 37/00* (2006.01)

(52) U.S. Cl. ..... 5/625; 182/139; 182/138

(58) Field of Classification Search ..... 5/627, 5/625; 182/137, 138, 139
See application file for complete search history.

(56) References Cited

U.S. PATENT DOCUMENTS

| | | | | |
|---|---|---|---|---|
| 2,220,330 | A * | 11/1940 | Hilger | 5/97 |
| 2,813,745 | A * | 11/1957 | Frieder et al. | 294/77 |
| 5,050,924 | A | 9/1991 | Hansen | 296/100.15 |
| 5,503,448 | A | 4/1996 | Dewey | 294/152 |
| 5,515,549 | A | 5/1996 | Wang | 5/625 |
| 5,622,300 | A | 4/1997 | Robinson | 224/575 |
| 5,720,303 | A | 2/1998 | Richardson | 128/870 |
| 5,967,145 | A | 10/1999 | Knapik et al. | 128/869 |
| 5,978,989 | A * | 11/1999 | Chavez | 5/627 |
| 6,039,376 | A | 3/2000 | Lopreiato | 294/152 |
| 6,161,648 | A * | 12/2000 | Rexroad et al. | 182/138 |
| 6,182,790 | B1 * | 2/2001 | Denny et al. | 182/138 |
| 6,508,389 | B1 | 1/2003 | Ripoyla et al. | 224/157 |
| 2004/0081946 | A1 * | 4/2004 | Hensley | 434/247 |

OTHER PUBLICATIONS

Pine Springs Ranch, "Trust Fall", Copyright 2000-2001, Camp Solutions LLC, pp. 1-2.*
RYLA 2001 Workshop, "Trust Fall", pp. 1-2.*

* cited by examiner

*Primary Examiner*—Thomas B. Will
*Assistant Examiner*—Tara L. Mayo

(57) ABSTRACT

A device and method for catching a person who is participating in a trust fall exercise in a ropes course. The device is constructed of a sheet of strong, flexible material that is provided with straps of reinforcing material, that extend under the sheet from side to side and from top to bottom. Each end of the straps is formed into a loop. The loops at the sides and the top of the sheet serves as handles by which team members grasp the device when catching a person on the device, and loops at the bottom of the sheet are to secure the device to a platform on which the person who is to be caught stands prior to falling backward off of the platform and onto the device.

1 Claim, 2 Drawing Sheets

METHOD OF CATCHING IN TRUST FALL IN ROPES COURSE

BACKGROUND OF THE INVENTION

1. Field of the Invention

The present invention relates to a device for catching a person who is participating in a trust fall exercise in a ropes course and a method of catching the person employing the device. The device is constructed of a sheet of flexible material, such as for example a sheet of canvas or nylon, that is provided with straps of reinforcing material, such as nylon, that extend under the sheet. The sheet is sufficiently long and sufficiently wide to allow a person to be caught thereon when the person falls backward in a trust fall exercise, and the straps extend beyond the sheet forming loops at the edges of the sheet that can be easily grasped by those participants who will be catching the person that is falling and can be secured to the platform from which the person is falling to insures that the person is not injured when they fall.

2. Description of the Related Art

Ropes courses have become popular vehicles for training teamwork for a variety of groups or teams of people. For example, groups from corporations, churches, and social organizations frequently participate in ropes courses to build trust among the team members so that the team will be more cohesive or productive.

One exercise that is often employed in ropes courses is a trust fall exercise. This exercise is conducted by having one member of the team stand with their back to the remaining members of the team, usually on an elevated stand, and then fall backwards, allowing the remaining members of the team to catch the person before the person hits the ground. The members of the team who are assigned the task of catching the person must interlace their arms to form a bed or blanket of human arms into which the person falls. In order for the person who is falling to allow himself to fall backward in this exercise, he must place his trust in his fellow team members that the team members will catch him and not allow him to be injured. If successfully performed, this exercise reinforces the trust between the person who is falling and the members of the team who catch the person.

However, sometimes the exercise is not performed successfully and the person who is falling is injured, sometimes seriously. When the exercise in not performed successfully, one or more of the members of the team who are attempting to catch the person may also be injured. These injuries range from minor scrapes and bruises to more serious injuries including major lacerations, broken bones, concussions, and internal injuries. Even if the injuries resulting from failure of this exercise are not serious, the failed exercise does not accomplish its purpose, i.e. to create trust among the members of the team. Instead, when the exercise fails, the members of the team will be fearful and mistrust each other, possibly blaming each other for the failure. Such mistrust can damage the team's ability to form a cohesive unit and this psychological and emotional damage can be difficult or impossible to reverse.

A team almost never drops a person during a trust fall exercise because they didn't try hard enough to catch the person. In fact, when the exercise fails, members of the team will often injure themselves in an attempt to prevent the person who is falling from being dropped and injured. This can result in injury of both the person who is falling and in injury of one or more of the people who are attempting to catch the person.

One of the reasons why a person might be dropped by the team is that it can be difficult to form a secure bed using only the team member's arms. For example, if one member of the team is not physically strong, they may not be able to grasp the arms of their fellow member's arms tightly enough to withstand the force that the body of the falling person exerts on the arms of the team members who are catching the falling person. When one member forming the bed of human arms falls or their arms give way, the entire bed fails. Stated another way, the bed is only as strong as its weakest link. Even if a stronger member of the team is standing next to the weakest member, the stronger member's strength can not be used to compensate for the failure of the weaker member to maintain the human bed in this exercise.

Another reason why a person might be dropped by the team is that the person may miss the bed. Because the bed is formed by the arms of the team members and is limited in width by the length of the member's arms, the person may fall in such a way that he misses the center of the bed. When this happens, he falls onto one or more of the team members. This exerting excessive force on those team members and when this happens, the members on whom the person falls can be knocked down. When one of the members falls, this causes the bed of human arms to fail and the person is not caught by the bed. When this happens, injury can be inflicted on the person who is falling, those members on whom the person falls, and other members who are also pulled down or fall as a result of the failure of the bed.

Still another reason why a person might be injured when falling is that the bed of human arms that is suppose to catch the person may not be positioned close enough to the platform to catch the person's feet and legs as he falls.

Thus, a new, more reliable way of catching people who are participating in trust fall exercises is needed in order to prevent emotional and physical damage to the participants that can result if the exercise is not successfully performed.

The present invention addresses this need by providing a strong unitary sheet of material onto which the person falls and is caught. The sheet is sufficiently long and wide so that the person who is falling can not miss falling onto the sheet as they fall backward. The present invention is provided with straps that run under the sheet and reinforce the strength of the unitary sheet so that the sheet does not rip or otherwise fail when force is exerted on it. The straps form a plurality of loops on both sides of the sheet and at the top and bottom of the sheet. The loops on both side of the sheet and at the top of the sheet are designed so that they can be easily and secured grasped by the members of the team and the loops at the bottom of the sheet can be secured to the platform from which the person is falling. When the loops are thus grasped and secured, the sheet is pulled taut from side to side by the members who are holding the loops of each side of the sheet, and the sheet is pulled taut from top to bottom by members who are holding the loops at the top of the sheet and by the platform to which the loops at the bottom of the sheet are secured. With the sheet pulled taut from top to bottom, this insures that the feet and legs of the person who is falling will be caught by the device.

SUMMARY OF THE INVENTION

The present invention is a device for catching a person who is participating in a trust fall exercise in a ropes course and a method of catching the person employing the device. The device is constructed of a unitary sheet of strong, flexible material, such as for example a sheet of canvas or nylon, that is provided with straps of reinforcing material, such as nylon, that extend under the sheet from side to side and from top to bottom. The sheet is sufficiently long and sufficiently wide so that the person who is falling can not miss falling onto the sheet when they fall backward in a trust fall exercise.

The straps run under the sheet and are secured thereto. The straps that extend between the two sides of the sheet are approximately parallel with each other and are spaced apart from each other. The straps that extend between the top and bottom of the sheet are approximately parallel with each other and are spaced apart from each other. The straps that extend between the two sides of the sheet are approximately perpendicular to the straps that extend between the top and bottom of the sheet. The straps serve to reinforce the strength of the unitary sheet so that the sheet does not rip or otherwise fail when force is exerted on it.

The straps extend beyond the sheet forming a plurality of loops at the top, bottom and both side edges of the sheet. The loops at the top of the sheet and on both sides of the sheet are designed so that they can be easily grasped by those participants who will be catching the person that is falling and the loops at the bottom of the sheet are designed so that they can be secured to the platform from which the person is falling.

When the loops are thus grasped by the members of the team and secured to the platform, the sheet is pulled taut from side to side by the members who are holding the loops of each side of the sheet to provide a secure bed onto which the person who is falling can safely land. The sheet is simultaneously also pulled taut from top to bottom by members who are holding the loops at the top of the sheet. By pulling the sheet taut from top to bottom, this insures that the feet and legs of the person who is falling will be caught by the device.

DETAILED DESCRIPTION OF THE PREFERRED EMBODIMENT THE INVENTION

Figure 1:
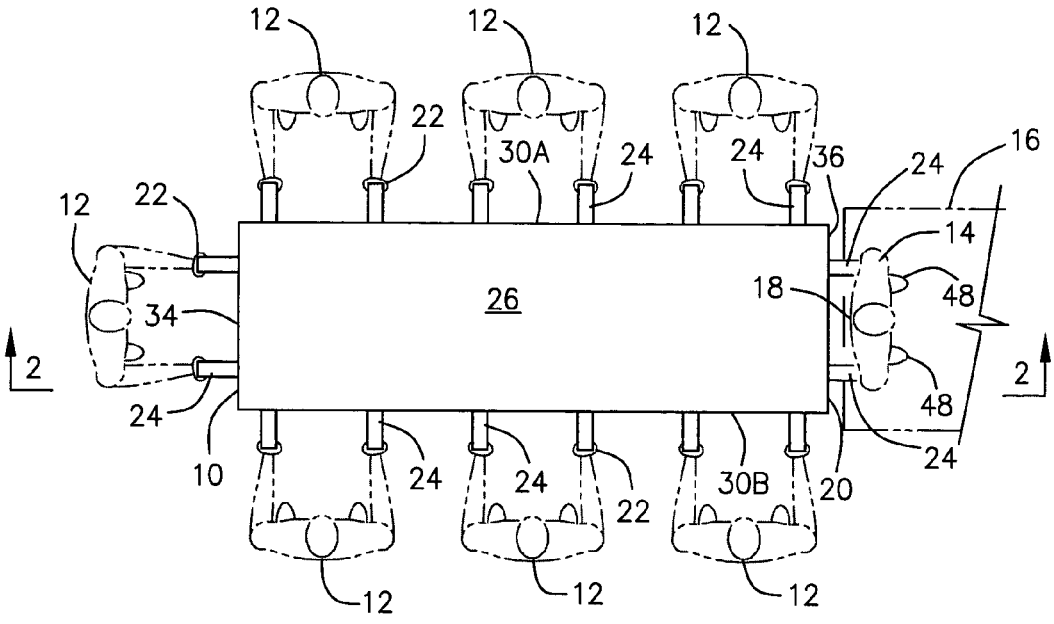
FIG. 1 is a top view of a device for catching a person in a trust fall exercise that is constructed in accordance with a preferred embodiment of the present invention shown in use.
Figure 2:
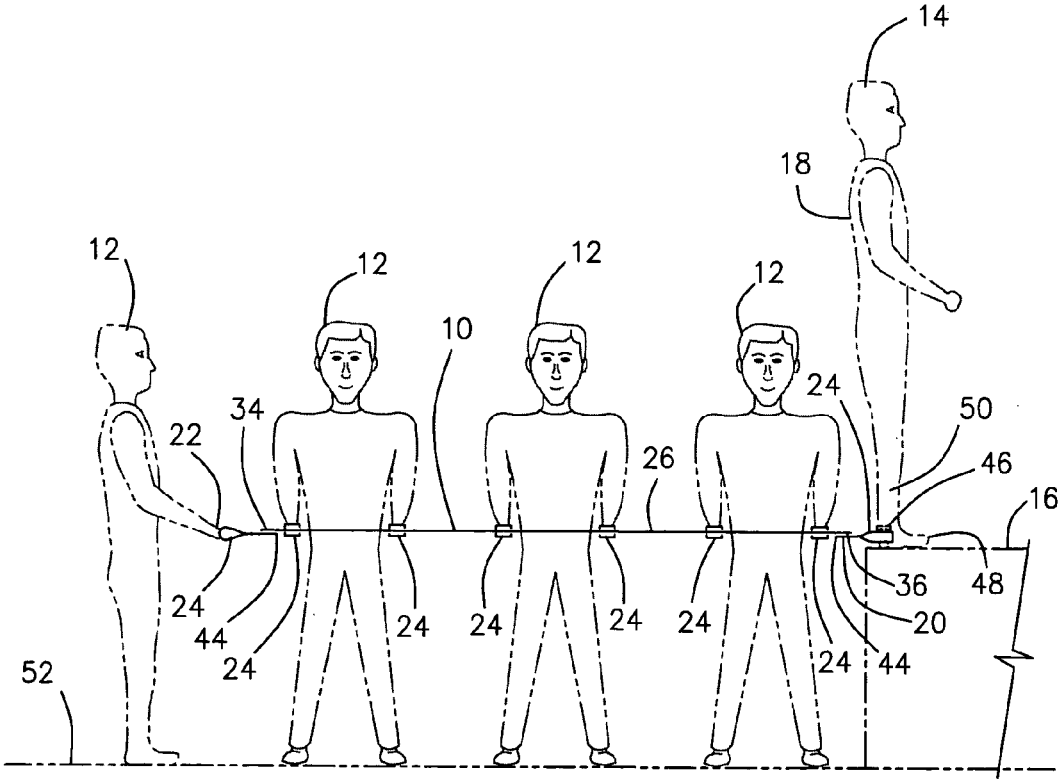
FIG. 2 is a cross sectional view of the device of FIG. 1 shown taken along line 2—2.
Figure 3:
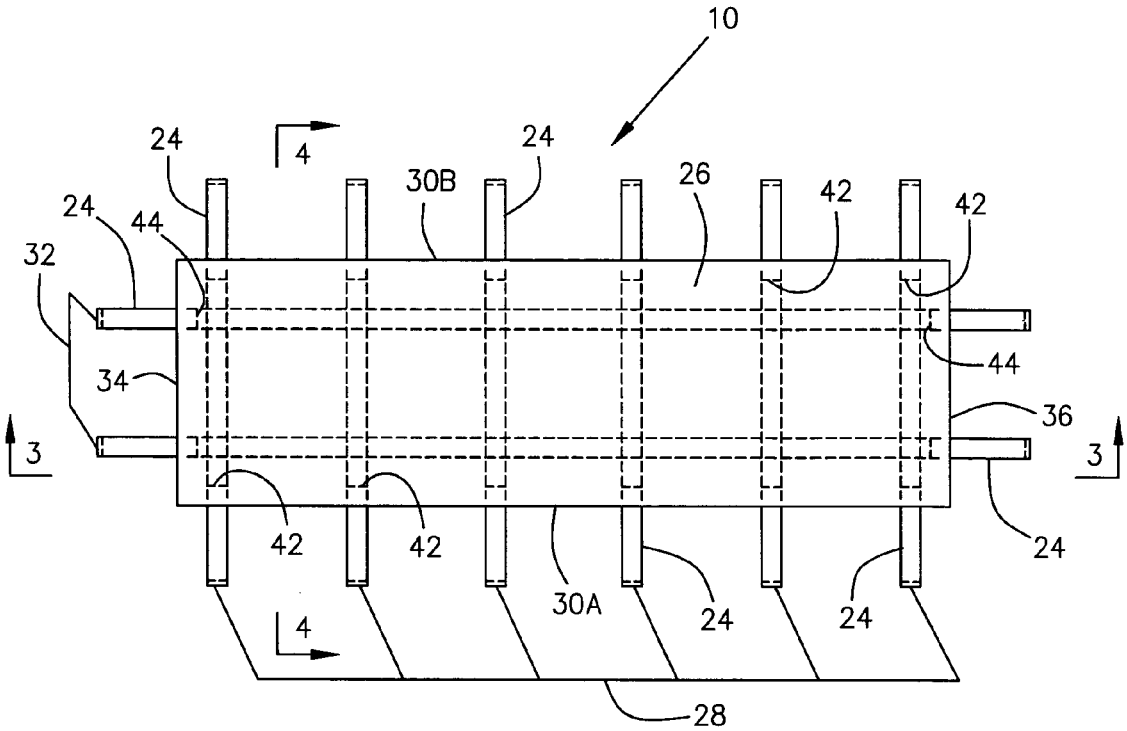
FIG. 3 is a top plan view of the device of FIG. 1.
Figure 4:
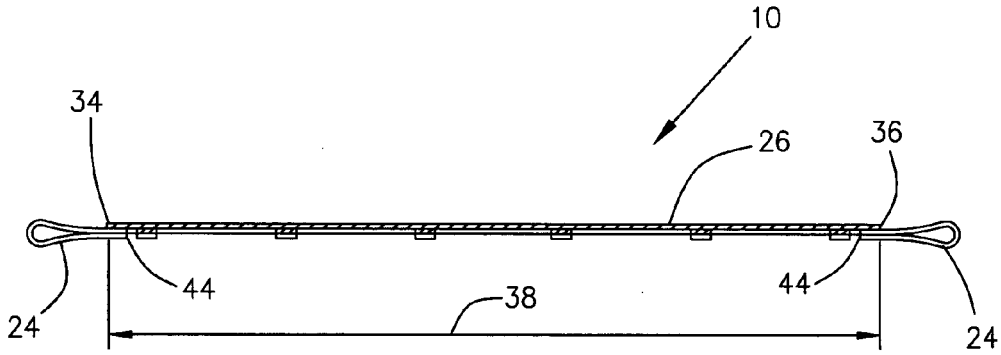
FIG. 4 is a cross sectional view of the device taken along line 4—4 of FIG. 3.
Figure 5:
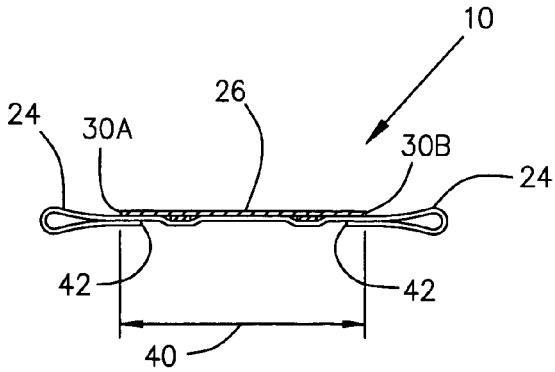
FIG. 5 is a cross sectional view of the device taken along line 5—5 of FIG. 3.

Referring now to the drawings and initially to FIGS. 3–5, there is illustrated a device 10 that is constructed in accordance with a preferred embodiment of the present invention for use in conducting a trust fall exercise in a ropes course. As illustrated in FIGS. 1 and 2, the device 10 is used by team members 12 to catching a person 14 who is participating in a trust fall exercise by falling backward off of a platform 16 and allowing the team members 12 to catch him. In conducting the trust fall exercise, the person 14 first stands on a raised platform 16 with his back 18 to the members 12 of the team who will catch him. Next, the members 12 position the device 10 behind the person 14, attach a bottom end 20 of the device 10 it to the platform 16, and pull the device 10 taut by grasping with their hands 22 loops 24 that are provided on the device 10 for this purpose. Finally, the person 14 falls backward and is caught on the device 10 by the team members 12 that are holding the device 10.

The device 10 is constructed of a unitary sheet 26 of strong, flexible material, such as for example a sheet of canvas or nylon. The sheet 26 is preferably cut into a rectangular shape. The sheet 26 is provided with a first group of straps 28 made of reinforcing material, such as nylon, that extend under the sheet 26 from one side edge 30A of the sheet 26 to an opposite side edge 30B of the sheet 26 and also provided with a second group of straps 32 that extend under the sheet 26 from a top edge 34 of the sheet 26 to a bottom edge 36 of the sheet 26.

The sheet 26 is preferably sufficient in length 38, i.e. the distance from the top edge 34 to the bottom edge 36, and also sufficient in width 40, i.e. the distance between the side edges 30A and 30B, so that the person 14 who is falling can not miss falling onto the sheet 26 when he falls backward in a trust fall exercise.

The first group of straps 28 run under the sheet 26 and are secured thereto. Ends 42 of each of the first group straps 28 extend beyond both side edges 30A and 30B of the sheet 26 and are folded back and secured to themselves to form two loops 24 on each strap 28. The first group straps 28 are approximately parallel with each other and are spaced apart from each other so that team members 12 can stand at the side edges 30A and 30B, with one member 12 located between each set of adjacent first group of straps 28.

The second group of straps 32 also run under the sheet 26 and are secured thereto. Ends 44 of each of the second group straps 32 extend beyond the top edge 34 of the sheet 26 and beyond the bottom edge 36 of the sheet 26. The second group straps 32 are approximately parallel with each other and are spaced apart from each other so that team members 12 can stand at the top edge 34 of the sheet 26, with one member 12 located between each set of adjacent second group of straps 32 and so that the second group straps 32 provided on the bottom edge 36 of the sheet 26 can be secured to the platform 16 on which the person 14 who will fall is to stand prior to falling backward. The first group straps 28 are approximately perpendicular to the second group straps 32 and the first and second group straps 28 and 32 are secured together where they intersect with each other. One of the functions of the straps 28 and 32 is to reinforce the strength of the unitary sheet 26 so that the sheet 26 does not rip or otherwise fail when force is exerted on it as the person 14 falls onto the device 10.

Each end 42 and 44 of the straps 28 and 32 extends beyond the sheet 26 and is folded back on itself and secured to itself to form a loop 24. Together the ends 42 and 44 collectively form a plurality of loops 24 at the top edge 34, the bottom edge 36 and on both side edges 30A and 30B of the sheet 26. The loops 24 at the top edge 34 of the sheet 26 and on both sides edges 30A and 30B of the sheet 26 are designed so that they can be easily grasped by of those team members 12 who will be catching the person 14 by positioning a team member 12 between each set of adjacent loops 24 and having each team member 12 grasp the two loops 24 located on either side of them in the team member's hands, as illustrated in FIGS. 1 and 2. The loops 24 at the bottom edge 36 of the sheet 26 are designed so that they can be secured to a pair of receiving pins 46 provided on the platform 16 from which the person 14 is to fall.

When the loops 24 are thus grasped by members 12 of the team and secured to the receiving pins 46 on the platform 16, the members 12 on either side of the device 10 pull the first set of loops to pull the sheet 26 taut between the two side edges 30A and 30B, thus providing a secure bed onto which the person 14 who is falling can safely land. The sheet 26 is simultaneously also pulled taut between the top and bottom edges 34 and 36 by other members 12 who are holding the loops 24 at the top edge 34 of the sheet 26. Pulling the sheet 26 taut between the top and bottom edges 34 and 36 helps to insure that the feet 48 and legs 50 of the person 14 who is falling will be caught by the device 10 and will not strike the ground 52.

As illustrated, the device 10 is preferably provided with an even number of first group straps 28 and an even number of second group straps so that each team member 12 will have two loops 24 to grasp, however, the invention is not so limited.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A method of catching a person in a trust fall activity comprising the following steps:

a. positioning a rectangular sheet of a device for catching in trust fall behind a person who is to fall backwards so that a top edge of the sheet extends away from the person who is to fall and a bottom edge of the sheet is located at the feet of the person who is to fall, b. positioning team members at the top and side edges of the sheet so that one team member is located between adjacent loops provided at the edges of the sheet, c. attaching loops provided at the bottom edge of the sheet to a platform on which the person who is to fall will stand so that the loops attach to the platform behind where the person stands immediately prior to the person falling backward onto the sheet, d. pulling the sheet taut by having each team member grasp a pair of adjacent loops provided on the edges of the sheet so that the sheet is supported above the ground, and e. having the team members continuously support the sheet above the ground as the person falls backward onto the sheet.

* * * * *